US007744441B2

(12) United States Patent
Sosnovskiy

(10) Patent No.: US 7,744,441 B2
(45) Date of Patent: Jun. 29, 2010

(54) INTERACTIVE PLAY SETS

(75) Inventor: Vladimir Sosnovskiy, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 380 days.

(21) Appl. No.: 11/266,725

(22) Filed: Nov. 2, 2005

(65) Prior Publication Data

US 2007/0293119 A1 Dec. 20, 2007

Related U.S. Application Data

(60) Provisional application No. 60/625,425, filed on Nov. 5, 2004, provisional application No. 60/706,923, filed on Aug. 9, 2005.

(51) Int. Cl.
*A63H 30/00* (2006.01)

(52) U.S. Cl. ..... 446/175; 446/456; 700/245

(58) Field of Classification Search ..... 446/175, 446/454, 455–456; 463/1; 700/245, 262; 901/1

See application file for complete search history.

(56) References Cited

U.S. PATENT DOCUMENTS

| | | | | |
|---|---|---|---|---|
| 2,055,594 | A | 9/1936 | Steinecke | |
| 2,922,929 | A | 1/1960 | Cooper et al. | |
| 3,130,803 | A | 4/1964 | Wiggins | |
| 3,178,853 | A | 4/1965 | Greenwood et al. | |
| 3,308,577 | A | 3/1967 | Holt | |
| 3,314,189 | A | 4/1967 | Carroll | |
| 3,406,481 | A | 10/1968 | Tachi | |
| 3,643,375 | A | 2/1972 | Ginsberg et al. | |
| 3,742,507 | A | 6/1973 | Pirre | |
| 3,748,564 | A | 7/1973 | Ohba | |
| 3,812,929 | A | 5/1974 | Farque | |
| 3,849,931 | A | 11/1974 | Gulley, Jr. | |
| 3,867,786 | A | 2/1975 | Greenblatt | |
| 4,085,542 | A | 4/1978 | Mitamura | |
| 4,086,724 | A | 5/1978 | McCaslin | |
| 4,201,012 | A | 5/1980 | Marshall | |
| 4,232,865 | A | 11/1980 | Chen et al. | |
| 4,245,430 | A | 1/1981 | Hoyt | |
| 4,272,916 | A | 6/1981 | Giordano et al. | |
| 4,272,918 | A | 6/1981 | Inoue | |
| 4,612,472 | A | 9/1986 | Kakizaki et al. | |
| 4,627,511 | A | 12/1986 | Yajima | |
| 4,662,854 | A | 5/1987 | Fang | |
| 4,679,152 | A | 7/1987 | Perdue | |
| 4,717,364 | A * | 1/1988 | Furukawa | 446/175 |

(Continued)

FOREIGN PATENT DOCUMENTS

| | | |
|---|---|---|
| WO | WO 03/053533 | 7/2003 |

(Continued)

OTHER PUBLICATIONS

*Mobile Robots: inspirations to implementation,* Chpt. 5.3, Joseph L. Jones, 1993.

*Primary Examiner*—Peter DungBa Vo
*Assistant Examiner*—Alex F. R. P. Rada, II
(74) *Attorney, Agent, or Firm*—Kolisch Hartwell, P.C.

(57) ABSTRACT

The present disclosure is directed to interactive play sets that include play companions and play companion bases, and methods of guiding play companions to those play companion bases.

18 Claims, 3 Drawing Sheets

U.S. PATENT DOCUMENTS

| | | | |
|---|---|---|---|
| 4,777,416 | A | 10/1988 | George, II et al. |
| 4,828,525 | A | 5/1989 | Okano |
| 4,844,493 | A | 7/1989 | Kramer |
| 4,846,297 | A | 7/1989 | Field et al. |
| 4,941,857 | A | 7/1990 | Fujimaki |
| 4,987,349 | A | 1/1991 | Nakamura |
| 5,083,968 | A | 1/1992 | Hart |
| 5,141,464 | A | 8/1992 | Stern et al. |
| 5,180,023 | A | 1/1993 | Reimers |
| 5,209,695 | A | 5/1993 | Rothschild |
| 5,227,973 | A | 7/1993 | Marcantonio |
| 5,281,182 | A | 1/1994 | Yoneda et al. |
| 5,324,225 | A | 6/1994 | Satoh et al. |
| 5,350,982 | A | 9/1994 | Seib |
| 5,440,216 | A | 8/1995 | Kim |
| 5,471,192 | A | 11/1995 | Dash |
| 5,517,098 | A | 5/1996 | Dong |
| 5,554,914 | A | 9/1996 | Miyazawa |
| 5,610,488 | A | 3/1997 | Miyazawa |
| 5,630,743 | A | 5/1997 | Shi |
| 5,765,508 | A | 6/1998 | Markowitz |
| 5,847,854 | A | 12/1998 | Benson, Jr. |
| 5,892,350 | A | 4/1999 | Yoshikawa |
| 5,893,791 | A | 4/1999 | Wilkinson |
| 6,007,401 | A | 12/1999 | Cyrus et al. |
| 6,012,957 | A | 1/2000 | Cyrus et al. |
| 6,076,226 | A | 6/2000 | Reed |
| 6,083,104 | A | 7/2000 | Choi |
| 6,091,956 | A | 7/2000 | Hollenberg |
| 6,142,251 | A | 11/2000 | Bail |
| 6,149,490 | A | 11/2000 | Hampton et al. |
| 6,171,172 | B1 | 1/2001 | Foster et al. |
| 6,224,454 | B1 | 5/2001 | Cheng et al. |
| 6,225,615 | B1 | 5/2001 | Yang |
| 6,227,966 | B1 | 5/2001 | Yokoi |
| 6,278,917 | B1 | 8/2001 | Bauer et al. |
| 6,389,329 | B1 | 5/2002 | Colens |
| 6,504,610 | B1 | 1/2003 | Bauer et al. |
| 6,532,404 | B2 * | 3/2003 | Colens ..... 700/262 |
| 6,748,297 | B2 | 6/2004 | Song et al. |
| 6,764,373 | B1 | 7/2004 | Osawa et al. |
| 7,275,431 | B2 * | 10/2007 | Zimmermann et al. ..... 73/510 |
| 2002/0089297 | A1 * | 7/2002 | Filo ..... 318/568.12 |

FOREIGN PATENT DOCUMENTS

| | | |
|---|---|---|
| WO | WO 2006/047584 | 5/2006 |

* cited by examiner

INTERACTIVE PLAY SETS

CROSS-REFERENCE TO RELATED APPLICATIONS

This application claims priority under 35 U.S.C. §119(e) to U.S. Provisional Patent Application Ser. No. 60/625,425 entitled "Play Companion," filed Nov. 5, 2004, and U.S. Provisional Patent Application Ser. No. 60/706,923 entitled "Positioning Systems for Interactive Play Sets," filed Aug. 9, 2005. The complete disclosures of both patent applications are hereby incorporated by reference for all purposes.

BACKGROUND OF THE DISCLOSURE

Many toys exist that simulate a companion that a child may play with. Conventional toys in this genre have been passive toys that do not move or make noise on their own. In order to improve the realism of companion toys, some have been designed to make a limited amount of noises and/or perform a limited amount of movements. Such play companions, however, typically cannot behave in an intelligent manner in which they naturally react to a child. Because some children may prefer to play with realistic toys, play companions that intelligently respond to input from a child may be desirable. Those play companions may require motion and/or positioning systems to direct the play companions to suitable targets, such as the child, another toy, and/or a base.

Examples of toys with motion and/or positioning systems include U.S. Pat. Nos. 2,922,929; 3,130,803; 3,178,853; 3,308,577; 3,643,375; 3,742,507; 3,748,564; 3,812,929; 3,849,931; 3,867,786; 4,085,542; 4,232,865; 4,272,916; 4,627,511; 4,662,854; 4,679,152; 4,777,416; 4,828,525; 4,844,493; 4,846,297; 4,941,857; 4,987,349; 5,083,968; 5,141,464; 5,227,973; 5,324,225; 5,440,216; 5,471,192; 5,517,098; 5,554,914; 5,610,488; 5,630,743; 5,765,508; 5,892,350; 5,893,791; 6,007,401; 6,076,226; 6,102,957; 6,149,490; 6,171,172; 6,224,454; 6,225,615; 6,278,917; 6,389,329; 6,504,610; 6,532,404; 6,748,297; and 6,764,373; and International Publication No. WO 03/053533. The complete disclosures of the above patents and patent application are hereby incorporated by reference for all purposes.

SUMMARY OF THE DISCLOSURE

Some embodiments provide a play companion base for a play companion. The play companion base comprises a base area and a positioning system configured to guide the play companion. The positioning system includes a first navigation beacon configured to guide the play companion when the play companion is in a first coverage area, a second navigation beacon configured to guide the play companion when the play companion is in a second coverage area, and a third navigation beacon configured to guide the play companion when the play companion is in a third coverage area. At least a portion of the base area is within the third coverage area, and at least a substantial portion of the third coverage area is within the first coverage area.

Some embodiments provide an interactive play set. The interactive play set comprises a play companion configured to interact with a user and a play companion base configured to at least partially contain the play companion. The play companion base includes a positioning system configured to guide the play companion to the play companion base. The positioning system includes a first light emitter configured to guide the play companion when the play companion is in a first coverage area, a second light emitter configured to guide the play companion when the play companion is in a second coverage area, and a third light emitter configured to guide the play companion when the play companion is in a third coverage area. At least a substantial portion of the second coverage area is within the first coverage area.

Some embodiments provide a method of guiding a play companion to a base area. The method comprises emitting a first light beam in a first coverage area; emitting a second light beam in a second coverage area, where the second coverage area is adjacent the base area; emitting a third light beam in a third coverage area, where at least a portion of the base area is within the third coverage area; and transmitting instructions to the play companion when at least a portion of the play companion is within at least one of the first, second, and third coverage areas. At least a substantial portion of the third coverage area is within the first coverage area.

DETAILED DESCRIPTION OF THE DISCLOSURE

Figure 1:
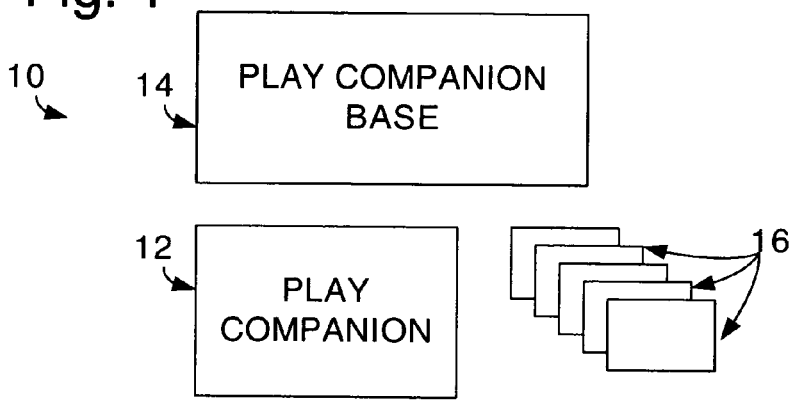
FIG. 1 is a schematic view of some embodiments of an interactive play set.

FIG. 1 shows some embodiments of an interactive play set 10, which may include a play companion 12, a play companion base 14, and one or more play companion accessories 16. The play companion may take the form of an interactive toy pet and/or a fantastical companion. For example, the play companion may take the form of a toy dog, toy cat, toy rabbit, toy bird, toy fish, etc. Alternatively, the play companion may take the form of a fantastical companion, such as a unicorn, a gnome, or other companion based on one or more creatures that do not exist. The play companion may be configured to simulate a real-life companion. For example, a toy dog may be configured to walk and run like a dog, to make dog noises, to play like a dog, etc. Additionally, a toy bird may be configured to move like a bird, to fly like a bird, to make bird noises, etc.

Figure 2:
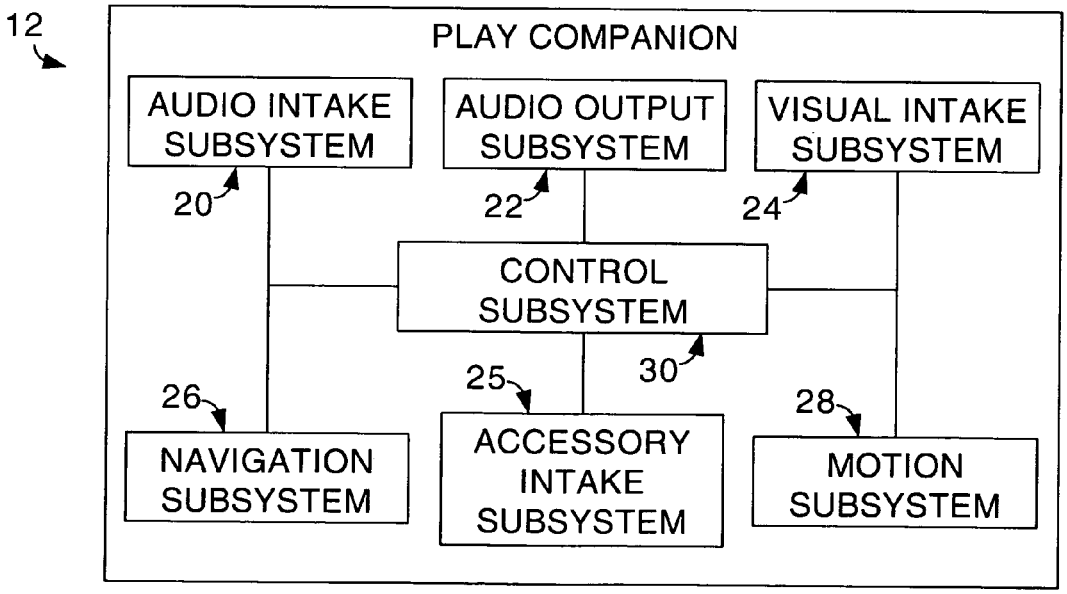
FIG. 2 is a schematic view of a play companion of the interactive play set of FIG. 1.

Moreover, the play companion may include any suitable combination of components configured to allow the play companion to interact with the user and/or be guided by the positioning system. For example, as shown in FIG. 2, play companion 12 may include an audio intake subsystem 20, an audio output subsystem 22, a visual intake subsystem 24, an accessory intake subsystem 25, a navigation subsystem 26, a motion subsystem 28, and a control subsystem 30.

Audio intake subsystem 20 may include any suitable structure configured to detect audible commands and/or other types of audible stimulus. For example, the audio intake subsystem may include a microphone and a command recognition module. The audio intake subsystem may be configured to recognize any suitable "come play" commands and/or other types of commands that are spoken by a user. The audio intake subsystem may communicate the detected command to control subsystem 30, which in turn may direct the various subsystems to function so that the play companion interacts with the user.

The audio intake subsystem also may be configured to detect extended periods of silence, which may indicate that a user no longer desires to play with the play companion. When extended periods of silence are detected, the audio intake subsystem may communicate a "rest" command to control subsystem 30, which in turn may direct the play companion to simulate taking a nap and/or returning to a play companion base.

The above are nonlimiting examples, and the audio intake subsystem may be configured to react to other audible stimulus. Although audio intake subsystem 20 is described to include a microphone and a command recognition module, the audio intake subsystem may include any suitable structure configured to detect audible commands and/or other types of audible stimulus (including extended periods of silence).

Audio output subsystem 22 may include any suitable structure configured to output sounds that are appropriate for a particular play companion. For example, the audio output system may include a sound transducer and a sound processor. The audio output system allows, for example, a play companion in the form of a bird may chirp, sing, and/or talk like a parrot, or a play companion in the form of a dog may bark, growl, yip, whine, and/or pant.

The audio output subsystem also may be configured to receive commands from control subsystem 30, which direct the audio output subsystem 22 to generate one or more sounds. For example, the control subsystem may be configured to cause the audio output subsystem to produce a "pant" noise when the play companion is running. Additionally, or alternatively, the control subsystem may be configured to cause the audio output subsystem to produce a "bark" noise when the audio intake subsystem receives a "speak" command from a user. Again, these are nonlimiting examples intended to indicate that variation of the basic concept is possible and within the scope of this disclosure.

Although audio output subsystem 22 is described to include a sound transducer and a sound processor, the audio output subsystem may include any suitable structure configured to output sounds that are appropriate for a particular play companion and/or to receive commands from control subsystem 30, which direct the audio output subsystem 22 to generate one or more sounds.

Visual intake subsystem 24 may include any suitable structure configured to provide control subsystem 30 with information relating to lighting conditions. For example, the visual intake subsystem may include a light sensor, a camera, and/or an image processor. The visual intake subsystem may allow the play companion to react to different lighting conditions. For example, if it gets dark, the visual intake subsystem may communicate the lighting condition to the control subsystem, which in turn may instruct the play companion to sleep, whine, return to the play companion base, and/or perform another suitable response to darkness.

Additionally, or alternatively, visual intake subsystem 24 may recognize different colors, shapes, and/or movements, and communicate such information to the control subsystem, which may direct one or more suitable responses. Although visual intake subsystem 24 is described to include a light sensor, a camera, and/or an image processor, the visual intake subsystem may include any suitable structure configured to provide control subsystem 30 with information relating to lighting conditions, colors, shapes, and/or movements.

Accessory subsystem 25 may include any suitable structure configured to detect one or more companion accessories. For example, the accessory subsystem may include one or more sensors. The sensors may be located in any suitable location(s) of the play companion. For example, one or more sensors may be located in a play companion's mouth for sensing when an accessory is placed in the play companion's mouth. Additionally, or alternatively, one or more sensors may be placed on the play companion's neck to determine when a user is petting the play companion's neck. Alternatively, or additionally, the sensors may detect when one or more accessories are adjacent or within a certain proximity of the play companion.

Although the sensors are described to be in the play companion's mouth and/or neck, the sensors may be located in any suitable location on, in, and/or proximate the play companion. Additionally, although accessory intake subsystem 25 is described to include one or more sensors, the accessory intake subsystem may include any suitable structure configured to detect one or more companion accessories.

Figure 3:
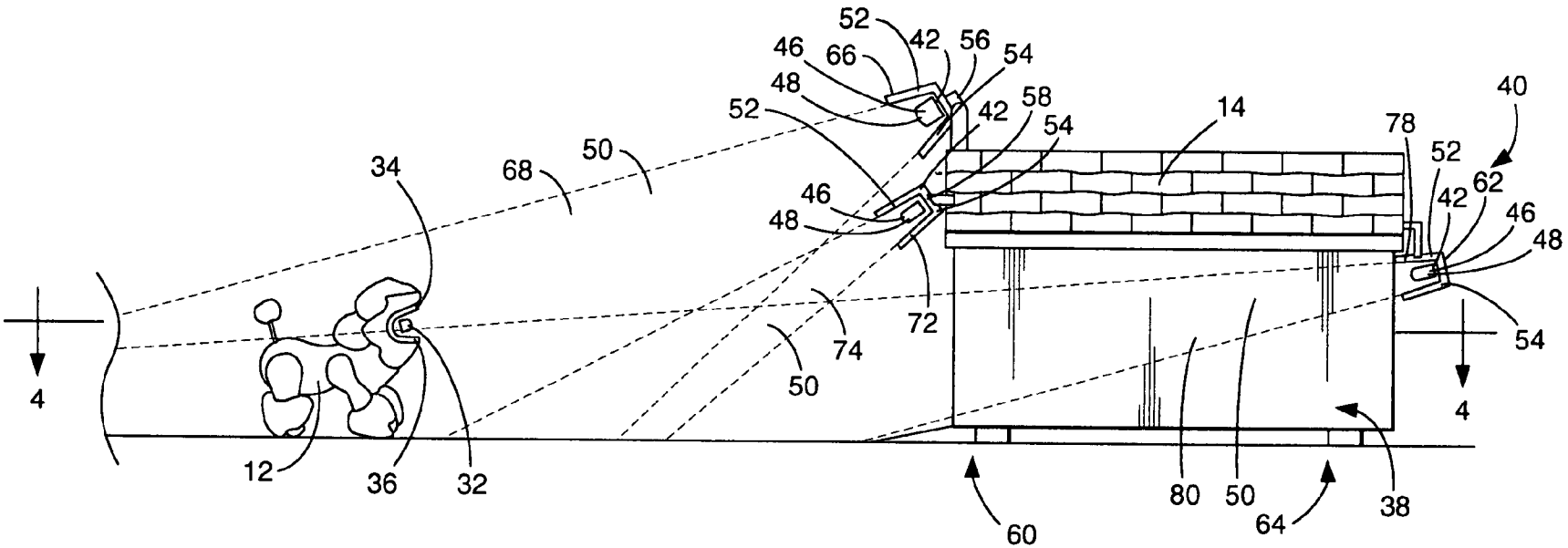
FIG. 3 is a side schematic view of the play companion and a play companion base of the interactive play set of FIG. 1.

Navigation subsystem 26 may include any suitable structure configured to provide control subsystem 30 with information regarding the location of the play companion in relation to the play companion base, the accessories, and/or any suitable reference point(s). The control subsystem may use the information from the navigation subsystem to direct or instruct the motion subsystem of the play companion towards any suitable direction(s) and/or target destination(s). For example, the navigation subsystem may include at least one sensor 32, as shown in FIG. 3. The sensor may include one or more light (or photo) and/or magnetic field sensors, which may be configured to detect one or more navigation beacons from the positioning system of the play companion base (as discussed below). The sensor may be configured to detect any suitable type of light, including infrared, visible, and/or ultraviolet light. Additionally, or alternatively, the sensor may be configured to receive one or more code or instructions from the positioning system of the play companion base.

The navigation subsystem also may include at least one sensitivity regulator 34, which may include any suitable structure configured to regulate the sensitivity of sensor 32. For example, regulator 34 may include at least one collimator 36, as shown in FIG. 3. Although sensitivity regulator 34 is shown to include collimator 36, the regulator may include any suitable structure configured to regulate the sensitivity of sensor 32. Additionally, although navigation subsystem 26 is shown to include sensor 32 and collimator 36, the navigation subsystem may include any suitable structure configured to provide control subsystem 30 with information regarding the location of the play companion in relation to the play companion base, the accessories, and/or any suitable reference point(s).

Motion subsystem 28 may include any suitable structure configured to move the play companion along one or more directions, which may be towards and/or away from one or more targets (such as the play companion base or one or more accessories). The motion subsystem also may include any suitable structure configured to receive commands from control subsystem 30, which may direct motion subsystem 28 to stop and/or to move the play companion along any suitable direction(s). For example, the motion subsystem may include various motors, wheels, joints, and other moveable parts.

Depending on the particular play companion, motion subsystem 28 may be configured to move the play companion from one location to another by walking, running, jumping, flying, and/or swimming. In some embodiments, the motion subsystem may move the play companion via one or more wheels. Motion subsystem 28 also may move other parts of the play companion to enhance life-like believability. For example, the motion subsystem may be configured to wag a tail, blink eyes, raise and lower ears, move a nose, open and close a mouth, etc.

Control subsystem 30 may include any suitable structure configured to control the actions of the play companion and/or to serve as a brain of the play companion. For example, the control subsystem may include a processor and a memory. The processor and memory may provide an artificial intelligence that controls the illustrative behaviors described above as well as any other desired suitable behaviors.

For example, the control subsystem may instruct the motion subsystem to move the play companion forward when the navigation subsystem (via the sensor) detects one or more navigation beacons of the play companion base, and/or instruct the motion subsystem to rotate the play companion when the navigation subsystem fails to detect one or more navigation beacons of the play companion base, or vice-versa. Although the control subsystem is described to instruct the motion subsystem in specific ways, the control subsystem may be configured to instruct the motion subsystem and/or other subsystems in any suitable way based on any suitable stimulus or stimuli.

Additionally, or alternatively, the control subsystem may follow the instructions received by the navigation subsystem (via the sensor). Those instructions may control the play companion in any suitable way, such as regulating the speed of the play companion's movements and/or the behavior. For example, sensor 32 may receive code from the play companion base to stop moving once the play companion has reached its intended destination, such as adjacent to or within a base area of the play companion base. Additionally, or alternatively, sensor 32 may receive code from the play companion base to move slower and/or turn slower, such as when the play companion base is near the base area.

An illustrative example of a behavior model that the control subsystem may follow is a sense-react model, in which the play companion senses a stimulus and then reacts to the stimulus in a predetermined manner. For example, the play companion may sense, via the audio intake subsystem, a "come play" command, and react by leaving a play companion base and initiating a play session. As another example, a play companion may sense that a companion accessory, such as a bone, has been placed in its mouth (or placed within a certain proximity) and react by pulling on the bone.

Although the processor and memory are described to provide an artificial intelligence following the sense-react model, the processor and memory may be configured to provide any suitable type of artificial intelligence following any suitable type(s) of behavior models. Additionally, although control subsystem 30 is described to include a processor and a memory, the control subsystem may include any suitable structure configured to control the actions of the play companion and/or to serve as a brain of the play companion.

Play companion base 14 may take the form of any suitable home or shelter corresponding to a particular play companion. For example, if the play companion is a toy dog, then the play companion base may be a doghouse, as shown in FIG. 3. Additionally, if the play companion is a toy bird, then the play companion base may be a birdcage. Moreover, if the play companion is a fish, then the play companion base may be a toy castle in a fish bowl. The play companion and the play companion base may be configured such that interaction between the play companion and the corresponding play companion base simulates a real interaction between a real pet, or other type of companion, and its home or shelter.

The play companion base may include a base area 38 and a positioning system 40. Base area 38 may include one or more portions of the play companion base configured to at least partially contain, shield, and/or support play companion 12. For example, when play companion base 14 is a doghouse, then the base area may be an inside portion of the doghouse. Alternatively, base area 38 may include one or more portions of the play companion base designated as a rest or home area of the play companion, regardless of whether those portions contain, shield, and/or support play companion 12.

Positioning system 40 may include any suitable structure configured to provide location information to navigation subsystem 26 of play companion 12. For example, the positioning system may include one or more navigation beacons 42. Each of those navigation beacons may have one or more coverage areas 44, which includes any area(s) in which the navigation subsystem of the play companion would detect the particular navigation beacon.

Navigation beacons 42 may include one or more light emitters 46, as shown in FIG. 3. The light emitters may include any suitable light source, such as one or more light emitting diodes (LEDs) 48. Additionally, light emitters 46 may emit one or more suitable light beams 50 including infrared, visible, and/or ultraviolet light beams. Although the navigation beacons are shown to include light emitters, any suitable type of beacons configured to be detected by the navigation subsystem of the play companion may be used.

Additionally, light emitters 46 may include one or more coverage regulators 52, which include any suitable structure configured to regulate the size and/or shape of the coverage area(s) associated with a particular light emitter. For example, the coverage regulators may include one or more collimators 54, which regulate the size and/or shape of light beam 50 of light emitter 46 and/or to direct the light beam to specific areas or zones, as shown in FIG. 3. The size of the light beams may be measured in any suitable way and/or any suitable location. For example, the size of a light beam may be measured by the size of the coverage area the light beam produces. Additionally, or alternatively, the size of a light beam may be measured by measuring the size of the coverage regulator, such as an outside area of the coverage regulator.

The collimators may provide for any suitable size(s) of light beams, such as broad or wide, spot, and/or narrow light beams. Although coverage regulators 52 are shown to include collimators 54, the coverage regulator may include any suitable structure configured to regulate the size and/or shape of the coverage area(s) associated with a particular light emitter.

Navigation beacons 42 also may be configured to provide code or instruction(s) to the play companion. For example, one or more navigation beacons may provide code to the play companion to stop moving once the play companion has reached its intended destination, such as adjacent to or within a base area of the play companion base. Additionally, or alternatively, the navigation beacons may provide code to the play companion to move slower and/or turn slower, such as when the play companion base is near the base area.

Alternatively, or additionally, navigation beacons 42 may provide code or instructions for the play companion to provide any suitable audio output, such as barking when the play companion is turning and/or in a specific coverage area. Although specific code or instructions have been discussed, the navigation beacons may be configured to provide any suitable code at any suitable place and/or time.

The navigation beacons may be arranged in any suitable way and/or locations configured to guide the play companion towards and/or away from the play companion base and/or other suitable target(s). The navigation beacons may additionally, or alternatively, be arranged such that the play companion detects at least one of the navigation beacons during at least a substantial portion of its travel towards its intended destination, such as base area 38 of the play companion base. For example, there may be "dead spots" in a coverage area where sensor 32 of the play companion may not detect a particular navigation beacon because one or more other portions of the play companion (such as collimator 36) may prevent the sensor from detecting the navigation beacon. Thus, additional navigation beacons may be provided and arranged to remove at least some of those dead spots.

Figure 4:
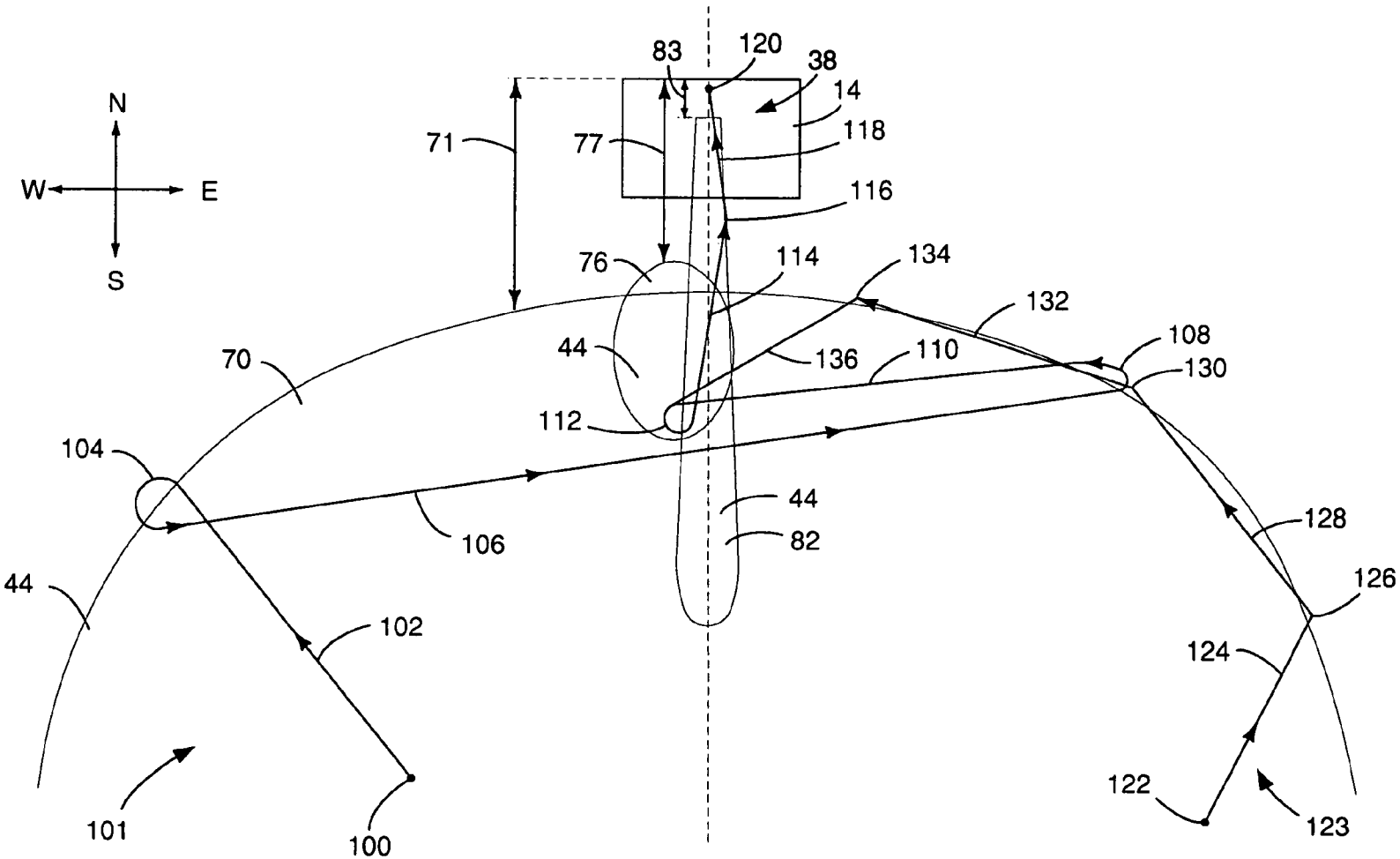
FIG. 4 is a cross-section schematic view of the interactive play set of FIG. 1 taken along lines 4-4 in FIG. 3, shown without the play companion to illustrate movements of the play companion towards the play companion base.

An illustrative example of a suitable arrangement of navigation beacons 42 with suitable coverage regulators 52 is shown in FIGS. 3-4. First and second navigation beacons 56 and 58 may be located adjacent a front portion 60 of the play companion base, while a third navigation beacon 62 may be located adjacent a rear portion 64 of the play companion base. First coverage regulator 66 may be configured to regulate the size of a first light beam 68 from the first navigation beacon to a first coverage area 70 that begins at a first distance 71 from rear portion 64. Second coverage regulator 72 may be configured to regulate the size of a second light beam 74 from the second navigation beacon to a second coverage area 76 that begins at a second distance 77 from rear portion 64. Similarly, third coverage regulator 78 may be configured to regulate the size of a third light beam 80 from the third navigation beacon to a third coverage area 82 that begins at a third distance 83 from rear portion 64.

First coverage area 70 may be larger than second coverage area 76 and/or third coverage area 82, and/or the third coverage area may be larger than the second coverage area, as shown in FIG. 4. In some embodiments, the first coverage area may be larger than the sum of the second and third coverage areas. First coverage area 70 may have an at least substantially circular shape, second coverage area 76 may have an oblong shape, and third coverage area 82 may have an elongate shape, as shown in FIG. 4.

The second and/or third coverage areas may at least partially overlap with the first coverage area configured to eliminate or reduce any dead spots. For example, at least a substantial portion of second coverage area 76 may be within first coverage area 70. Additionally, or alternatively, at least a substantial portion of the third coverage area may be within the first coverage area.

Although first, second, and third coverage areas 70, 76, and 82 are shown to have particular sizes, those areas may have any suitable size. For example, first and second coverage areas 70 and 76 may have equal sizes. Additionally, although the first, second, and third coverage areas are shown to have particular shapes, those areas may have any suitable shape(s). For example, first and second coverage areas 70 and 76 may both have at least substantially circular shapes.

Moreover, although second and third coverage areas 76 and 82 are shown to substantially overlap with first coverage area 70, the coverage areas may overlap in any suitable proportion or some or all of the areas may not overlap at all. For example, the first, second, and third coverage areas may be adjacent to each other without overlapping. Furthermore, although three coverage areas are shown, the navigation beacons may produce any suitable number of coverage areas. Additionally, although three navigation beacons are shown, more or less navigation beacons may be used.

Illustrative examples of how play companion 12 may be guided towards base area 38 of play companion base 14 are shown in FIG. 4. The play companion may begin at a starting point 100 (located in a western portion 101 of the first coverage area) facing a northwestern direction. Because play companion 12 is within first coverage area 70, sensor 32 may detect first light beam 68 and the play companion may move forward along a path 102. While on that path, the play companion may exit the first coverage area. As the play companion exits, the sensor may fail to detect any light beam and the play companion may rotate in a turn 104.

When sensor 32 detects first light beam 68 again, the play companion may move forward along a path 106. While on that path, the play companion may exit first coverage area 70 again. As the play companion exits, the sensor may fail to detect any light beam and the play companion may rotate in a turn 108. When sensor 32 detects the first light beam again, the play companion may move forward along a path 110.

While on path 110 and as the play companion enters second coverage area 76, sensor 32 may fail to detect the first light beam because sensitivity regulator 34 and/or other parts of the play companion may be between first light beam 68 and sensor 32. The sensor may, however, detect second light beam 74 and may continue along path 110. In some embodiments, the play companion may start moving slower (such as half the normal speed) as it enters the second coverage area.

Towards an end of path 110, the sensor may fail to detect the second light beam because sensitivity regulator 34 and/or other parts of the play companion may be between second light beam 74 and sensor 32. The play companion may rotate in a turn 112 and may enter third coverage area 82. In some embodiments, the play companion may start moving slower (such as half the normal speed) as it enters the third coverage area. Sensor 32 may then detect third light beam 80 and moves forward along path 114.

While on path 114, the play companion may exit third coverage area 82. As the play companion exits, sensor 32 may fail to detect the third light beam and may rotate in a turn 116. When the sensor detects third light beam 80 again, the play companion may move along path 118 and to a stopping point 120 at the base area of the play companion base. When the play companion reaches the base area, the third navigation beacon may send code and/or instructions for play companion 12 to stop.

Alternatively, play companion 12 may begin at a starting point 122 (in an eastern portion 123 of the first coverage area) facing a northeastern direction. Because play companion 12 is within first coverage area 70, sensor 32 may detect first light beam 68 and the play companion may move forward along a path 124. While on that path, the play companion may exit the first coverage area. As the play companion exits, the sensor may fail to detect any light beam and the play companion may rotate in a turn 126.

When sensor 32 detects first light beam 68 again, the play companion may move forward along a path 128. While on that path, the play companion may exit first coverage area 70 again. As the play companion exits, the sensor may fail to detect any light beam and the play companion may rotate in a turn 130. When sensor 32 detects the first light beam again, the play companion may move forward along a path 132.

While on that path, the play companion may exit first coverage area 70 again. As the play companion exits, the sensor may fail to detect any light beam and the play companion may rotate in a turn 134. When sensor 32 detects the first light beam again, the play companion may move forward along a path 136, which may connect with turn 112 of the previous example. After which, the play companion may move along the same paths and/or turns of the previous example until the play companion reaches stopping point 120. Alternatively, play companion 12 may move along different paths and/or turns until the play companion reaches stopping point 12.

Although two paths are shown, the play companion may take any suitable path(s) towards or away from the play companion base. Additionally, although the play companion is shown to rotate counterclockwise, the play companion may be configured to rotate clockwise or both clockwise and counterclockwise (alternating in random or in a predetermined pattern).

Moreover, although the play companion is shown to move forward when within a coverage area and rotate when outside a coverage area, the play companion may be configured to move in any suitable way and in any suitable direction inside and/or outside a coverage area. For example, the play companion may be configured to reverse when outside a coverage area and then rotate until it is within a coverage area again. Furthermore, although the play companion reacts the same way regardless of what coverage area the play companion is in, the play companion may be configured to react in different ways depending on which coverage area play companion 12 is in. For example, play companion 12 may move forward in the first coverage area, while turning and moving forward (concurrently or in an alternating fashion) in the second coverage area Additionally, although the play companion is shown to make curvilinear turns (such as turns 104 and 108) and rectilinear turns (such as turns 126 and 130), the play companion may be configured to make any suitable turns and in any suitable combination. For example, the play companion may take different types of turns (including curvilinear turns of different radii and rectilinear turns of different angles) along its travel back to the play companion base.

Moreover, although the play companion base is shown to move from the first coverage area to the second coverage area to the third coverage area, the play companion may move in any suitable sequence. For example, the play companion may start at a point that is within the third coverage area and may simply stay within the third coverage area as it travel towards the base area. Alternatively, the play companion may start at the second coverage area, then go to the first coverage area, and then the third coverage area.

Furthermore, although the play companion is shown to move to the base area of the play companion base, the play companion may be configured to move towards or away from other targets, such as accessories 16. When the play companion moves towards or away from other targets, those targets may include positioning systems similar to the positioning system of the play companion base. Alternatively, or additionally, the positioning of the play companion base may be configured to guide the play companion towards or away from the accessories.

Although interactive play sets and features of interactive play sets have been shown and described with reference to the foregoing operational principles and preferred embodiments, those skilled in the art will find apparent that various changes in form and detail may be made without departing from the spirit and scope of the claims. The present disclosure is intended to embrace all such alternatives, modifications, and variances that fall within the scope of the appended claims.

What is claimed is:

1. An interactive play set, comprising:

a play companion configured to interact with a user, the play companion including:

an audio intake subsystem configured to detect one or more audible commands from the user, an audio output system configured to output one or more sounds responsive to the detected audible commands, and a motion subsystem configured to move the play companion responsive to the detected audible commands;

a base area; and a positioning system configured to guide the motion subsystem of the play companion, the positioning system including:

a first navigation beacon configured to guide the motion subsystem of the play companion when the play companion is in a first coverage area;

a second navigation beacon configured to guide the motion subsystem of the play companion when the play companion is in a second coverage area; and a third navigation beacon configured to guide the motion subsystem of the play companion when the play companion is in a third coverage area, wherein at least a portion of the base area is within the third coverage area, the first coverage area being larger than the sum of the second and third coverage areas, wherein at least a substantial portion of the third coverage area is within the first coverage area, and wherein the audio intake system is configured to detect an extended period of silence and instruct the motion subsystem to move the play companion toward the base area.

2. The set of claim 1, wherein the positioning system is configured to guide the motion subsystem of the play companion to the base area.

3. The set of claim 1, wherein at least one of the first, second, and third navigation beacons includes a light emitter.

4. The set of claim 3, wherein the light emitter is configured to emit at least one of an infrared, visible, and ultraviolet light beam.

5. The set of claim 3, wherein the light emitter includes a light emitting diode.

6. The set of claim 1, wherein at least one of the first, second, and third navigation beacons includes a coverage regulator configured to regulate size of at least one of the first, second, and third coverage areas.

7. The set of claim 6, wherein the coverage regulator includes a collimator.

8. The set of claim 1, wherein at least a substantial portion of the second coverage area is within the first coverage area.

9. The set of claim 1, wherein the second coverage area is adjacent a front portion of the play companion base.

10. The set of claim 1, wherein at least one of the first, second, and third navigation beacons is configured to control the motion subsystem of the play companion.

11. The set of claim 10, wherein the at least one of the first, second, and third navigation beacons is configured to control the motion subsystem of the play companion when at least a portion of the play companion is within the base area.

12. An interactive play set, comprising:

a play companion configured to interact with a user, the play companion including an audio intake subsystem configured to detect one or more audible commands from the user, and a motion subsystem configured to move the play companion responsive to the detected audible commands; and a play companion base configured to at least partially contain the play companion, the play companion base including a positioning system configured to guide the motion subsystem of the play companion to the play companion base, wherein the positioning system includes:

a first light emitter configured to emit a first light beam to guide the motion subsystem of the play companion when the play companion is in a first coverage area;

a second light emitter configured to emit a second light beam to guide the motion subsystem of the play companion when the play companion is in a second coverage area; and a third light emitter configured to emit a third light beam to guide the motion subsystem of the play companion when the play companion is in a third coverage area, wherein the first light beam is broader than the second light beam and the third light beam, and wherein the audio intake system is configured to detect an extended period of silence and instruct the motion subsystem to move the play companion toward the play companion base.

13. The set of claim 12, wherein the third light emitter is configured to instruct the play companion to stop moving when at least a portion of the play companion is adjacent the play companion base.

14. The set of claim 13, wherein the third light emitter is configured to instruct the play companion to stop moving when at least a portion of the play companion is in the play companion base.

15. The set of claim 12, wherein the first, second, and third light emitters are configured to emit at least one of an infrared, a visible, and an ultraviolet light beam.

16. An interactive play set, comprising:

a play companion configured to interact with a user, the play companion including:

an audio intake subsystem configured to detect one or more audible commands from the user, a motion subsystem configured to move the play companion based in part on the detected audible commands from the user, and an audio output system configured to output one or more sounds based in part on the detected audible commands; and a play companion base configured to at least partially contain the play companion, the play companion base including a positioning system configured to guide the motion subsystem of the play companion to the play companion base, wherein the positioning system includes:

a first light emitter configured to emit a first light beam to guide the motion subsystem of the play companion when the play companion is in a first coverage area;

a second light emitter configured to emit a second light beam to guide the motion subsystem of the play companion when the play companion is in a second coverage area; and a third light emitter configured to emit a third light beam to guide the motion subsystem of the play companion when the play companion is in a third coverage area, and wherein the audio intake system is configured to detect an extended period of silence and instruct the motion subsystem to move the play companion toward the play companion base.

17. The set of claim 16, wherein the audio intake system is configured to instruct the audio output system to output one or more sounds when the extended period of silence is detected.

18. The set of claim 16, wherein the play companion is an interactive toy pet.

* * * * *